US006159266A

United States Patent [19]

Yoshimura et al.

[11] Patent Number: 6,159,266

[45] Date of Patent: Dec. 12, 2000

[54] SINTERED POWDER METAL BODIES AND PROCESS FOR PRODUCING THE SAME

[75] Inventors: Takashi Yoshimura, Kanagawa; Hiroyuki Amma, Yokohama; Masashi Fujinaga, Chiba, all of Japan

[73] Assignees: Unisia Jecs Corporation, Atsugi; Kawasaki Steel Corporation, Kobe, both of Japan

[21] Appl. No.: 09/308,711

[22] PCT Filed: Oct. 6, 1998

[86] PCT No.: PCT/JP98/04508

§ 371 Date: May 24, 1999

§ 102(e) Date: May 24, 1999

[87] PCT Pub. No.: WO99/19524

PCT Pub. Date: Apr. 22, 1999

[30] Foreign Application Priority Data

Oct. 14, 1997 [JP] Japan ..... 9-296377

[51] Int. Cl.[7] ..... C22C 33/02

[52] U.S. Cl. ..... 75/243; 75/246; 419/11; 419/38

[58] Field of Search ..... 75/243, 246; 419/38, 419/11

[56] References Cited

U.S. PATENT DOCUMENTS

| | | | |
|---|---|---|---|
| 5,108,493 | 4/1992 | Causton | 75/255 |
| 5,154,881 | 10/1992 | Rutz et al. | 419/37 |
| 5,368,630 | 11/1994 | Luk | 75/252 |
| 5,571,305 | 11/1996 | Uenosono et al. | 75/246 |
| 5,641,922 | 6/1997 | Shivanath et al. | 75/231 |
| 5,872,322 | 2/1999 | Mocarski et al. | 75/246 |

FOREIGN PATENT DOCUMENTS

| | | |
|---|---|---|
| 508993 | 2/1952 | Belgium . |
| 0 418 943 | 3/1991 | European Pat. Off. . |
| 1-123005 | 5/1989 | Japan . |
| 1-165702 | 6/1989 | Japan . |
| 7-173504 | 7/1995 | Japan . |
| 352352 | 4/1961 | Switzerland . |
| 1 402 660 | 8/1975 | United Kingdom . |

OTHER PUBLICATIONS

–Pamphlet —, "The Second Presentation of Development in Powder Metallurgy", Nov. 15, 1985, *Japan Powder Metallurgy Association.*

*Primary Examiner*—Ngoclan Mai
*Attorney, Agent, or Firm*—Foley & Lardner

[57] ABSTRACT

A process for producing a sintered powder metal body is disclosed. A powdery mixture is prepared by blending a graphite powder in amount of not less than 0.3% by weight with an iron based metal powder. The powdery mixture is compacted into a preform having a density of not less than 7.3 g/cm$^3$. The preform is sintered at a temperature of 800–1000° C. to form the sintered powder metal body having a predetermined structure. The predetermined structure of the sintered powder metal body includes iron based metal particles and graphite particles retained between the iron based metal particles.

15 Claims, 12 Drawing Sheets

0.5wt% GRAPHITE (BLENDED);
SINTERING TEMPERATURE 800°C

| DENSITY ($g/cm^3$) | ELONGATION (%) |
|---|---|
| 6.1 | 3.7 |
| 6.3 | 4.2 |
| 6.5 | 4.1 |
| 6.7 | 4.9 |
| 6.9 | 5.2 |
| 7.1 | 6.6 |
| 7.3 | 11.1 |
| 7.5 | 12.1 |

| SINTERING TEMPERATURE | ELONGATION (%) (DENSITY OF GREEN COMPACT : 7.3g / cm$^3$) | | | |
|---|---|---|---|---|
| | AMOUNT OF GRAPHITE (BLENDED, wt%) | | | |
| | 0.3 | 0.5 | 1.0 | 2.0 |
| 700°C | 4.0 | 4.5 | 3.1 | 3.3 |
| 800°C | 10.7 | 11.1 | 10.9 | 10.6 |
| 900°C | 15.8 | 16.2 | 15.5 | 14.8 |
| 950°C | 16.2 | 15.9 | 15.8 | 15.0 |
| 1000°C | 15.7 | 15.7 | 15.1 | 14.6 |
| 1100°C | 7.0 | 6.5 | 4.4 | 2.8 |

| SINTERING TEMPERATURE | ELONGATION (%) (DENSITY OF GREEN COMPACT : 7.5g / cm$^3$) | | | |
|---|---|---|---|---|
| | AMOUNT OF GRAPHITE (BLENDED, wt%) | | | |
| | 0.3 | 0.5 | 1.0 | 2.0 |
| 700°C | 4.4 | 4.2 | 3.2 | 3.7 |
| 800°C | 11.5 | 12.1 | 11.8 | 12.5 |
| 900°C | 17.3 | 16.9 | 16.5 | 16.2 |
| 950°C | 17.5 | 16.3 | 16.6 | 15.9 |
| 1000°C | 18.2 | 18.4 | 19.0 | 17.5 |
| 1100°C | 8.1 | 6.8 | 5.1 | 3.3 |

| SINTERING TEMPERATURE | HARDNESS (HRB) (DENSITY OF GREEN COMPACT : 7.3g / cm$^3$) | | | |
|---|---|---|---|---|
| | AMOUNT OF GRAPHITE (BLENDED, wt%) | | | |
| | 0.3 | 0.5 | 1.0 | 2.0 |
| 700°C | 43.1 | 44.3 | 44.9 | 43.6 |
| 800°C | 44.5 | 45.7 | 46.1 | 45.4 |
| 900°C | 49.9 | 48.8 | 46.3 | 46.8 |
| 950°C | 53.6 | 53.2 | 54.7 | 55.2 |
| 1000°C | 55.5 | 57.8 | 58.5 | 59.2 |
| 1100°C | 63.3 | 65.1 | 67.4 | 68.9 |

| SINTERING TEMPERATURE | HARDNESS (HRB) (DENSITY OF GREEN COMPACT : 7.5g / cm$^3$) | | | |
|---|---|---|---|---|
| | AMOUNT OF GRAPHITE (BLENDED, wt%) | | | |
| | 0.3 | 0.5 | 1.0 | 2.0 |
| 700°C | 48.5 | 47.7 | 48.2 | 45.5 |
| 800°C | 47.6 | 46.7 | 46.2 | 46.7 |
| 900°C | 50.0 | 50.6 | 49.5 | 49.3 |
| 950°C | 53.5 | 58.3 | 55.0 | 54.7 |
| 1000°C | 59.5 | 60.4 | 60.8 | 61.0 |
| 1100°C | 65.1 | 68.5 | 73.8 | 76.2 |

| SINTERING TEMPERATURE | YIELD POINT (MPa) (GRAPHITE : BLENDED, 0.5wt%, 20μm PARTICLE DIAMETER) | |
|---|---|---|
| | DENSITY OF GREEN COMPACT (g / cm$^3$) | |
| | 7.3 | 7.5 |
| 700°C | — | — |
| 800°C | 210 | 230 |
| 900°C | 185 | 216 |
| 950°C | 197 | 243 |
| 1000°C | 223 | 252 |
| 1100°C | 307 | 315 |

| SINTERING TEMPERATURE | YIELD POINT (MPa) (GRAPHITE : BLENDED, 0.5wt%, 5μm PARTICLE DIAMETER) | |
|---|---|---|
| | DENSITY OF GREEN COMPACT (g / cm$^3$) | |
| | 7.3 | 7.5 |
| 700°C | — | — |
| 800°C | 202 | 224 |
| 900°C | 215 | 246 |
| 950°C | 229 | 264 |
| 1000°C | 231 | 272 |
| 1100°C | 309 | 317 |

SINTERED POWDER METAL BODIES AND PROCESS FOR PRODUCING THE SAME

TECHNICAL FIELD

The present invention relates to sintered powder metal bodies suitable for various kinds of machine parts, and a process for producing the sintered powder metal bodies.

BACKGROUND ART

The process of producing sintered powder metal bodies basically includes the steps of mixing powders of raw materials, compressing the powdery mixture into a green compact, sintering the green compact, and conducting after-treatments such as heat treatment to form a final product. Although the final product may be produced by only the basic process, in many cases the final product are subjected to additional working and/or treatments depending on various applications thereof.

For instance, in order to obtain machine parts with an increased mechanical strength, Japanese Patent Application First Publication No. 1-123005 discloses a process for making sintered powder metal bodies. The process includes the steps of compacting a powder metal mixture into a green compact, sintering the green compact to form a preform, compressing the preform by cold forging, and sintering the compressed preform to form a final product. Specifically, the compressing (cold forging) step includes a first temporary-compressing step and a second regular-compressing step. The preform is coated with a lubricant before being compressed in the first temporary-compression step. Subsequent to being compressed in the first temporary-compressing step, the preform is subjected to a negative pressure so that the lubricant present in fine voids in the porous structure of the preform is evaporated and removed therefrom. Then, the preform is re-compressed in the second regular-compressing step.

In accordance with the proposed process, since the lubricant in the fine voids in the porous structure of the preform is removed, the porous structure is squeezed and the fine voids are eliminated in the second regular-compressing step. As a result, the preform may be compressed into the final product having a relatively high density of approximately 7.4–7.5 g /cm$^3$ which enhances the mechanical strength of the final product.

Meanwhile, in order to further enhance the mechanical strength of the final product, it will be appreciated to increase a carbon content of the final product, namely, an amount of a graphite powder admixed with a metal powder. However, generally, as the amount of the graphite powder admixed increases, an elongation of a sintered body obtained by sintering a preform which is made from the powdery mixture, decreases and a hardness thereof increases. This causes such a problem that, when the preform is re-compressed, deformability of the preform is reduced whereby the re-compression of the preform cannot be sufficiently achieved.

For example, a pamphlet entitled "The Second Presentation of Developments in Powder Metallurgy" issued on Nov. 15, 1985 by Japan Powder Metallurgy Association, page 90, discloses that a sintered body having a carbon content of 0.05–0.5% has an elongation of 10% and a hardness of Rockwell B Scale (HRB) 83. It is empirically known that, if a sintered body has an elongation of not more than 10% and a hardness of more than 60 HRB, the sintered body cannot be readily re-compressed into the final product. Therefore, there is a demand for obtaining a sintered body having an increased elongation and a reduced hardness and thus excellent deformability.

The present inventors have been devoted themselves to studies to obtain machine parts having a higher mechanical strength which are made from sintered metal. According to the studies by the present inventors, it has been noticed that, in a case where the machine parts are obtained by the steps of temporarily compressing a metal powder to form a preform, sintering the preform to form a sintered body and re-compressing and re-sintering the sintered body, characteristics of the sintered body are the important factors that determine the compressibility in the re-compressing step and mechanical properties of the machine parts to be obtained. Further, the present inventors have recognized that, in order to obtain the mechanically strengthened machine parts, it is necessary a sintered body formed contains a predetermined amount of graphite and has a greater elongation, a less hardness and a good deformability.

The present inventors have earnestly continued the studies. As a result of the present inventors' earnest studies, it has been found that the specific properties of the sintered body, especially the elongation and the hardness which give significant influences on the compressibility of the sintered body, have a close relationship with a density of the preform and a structure of the sintered body, particularly a state of the graphite in the structure of the sintered body.

It is an object of the present invention to provide a sintered powder metal body suitable for fabricating high-strengthened machine parts therefrom, which contains graphite in a predetermined amount and has a greater elongation, a less hardness and a good deformability.

It is a further object of the present invention to provide a process for producing the sintered powder metal body.

DISCLOSURE OF INVENTION

According to one aspect of the present invention, there is provided a process for producing a sintered powder metal body, comprising the steps of:

- blending a graphite powder with an iron based metal powder to form a powdery mixture, the graphite powder being present in an amount of not less than 0.3% by weight on the basis of the weight of said powdery mixture;
- compacting the powdery mixture into a preform having a density of not less than 7.3 g/cm$^3$; and
- sintering the preform at a predetermined temperature to form the sintered powder metal body having a predetermined structure.

According to a further aspect of the present invention, there is provided a sintered powder metal body produced by a process comprising the steps of:

- blending a graphite powder with an iron based metal powder to form a powdery mixture, the graphite powder being present in an amount of not less than 0.3% by weight on the basis of the weight of said powdery mixture;
- compacting the powdery mixture into a preform having a density of not less than 7.3 g/cm$^3$; and
- sintering the preform at a predetermined temperature to form the sintered powder metal body having a predetermined structure.

According to a still further aspect of the present invention, there is provided a sintered powder metal body having a predetermined structure, the predetermined structure comprising:

iron based metal particles; and graphite particles retained between the iron based metal particles.

BEST MODE FOR CARRYING OUT THE INVENTION

Figure 1:
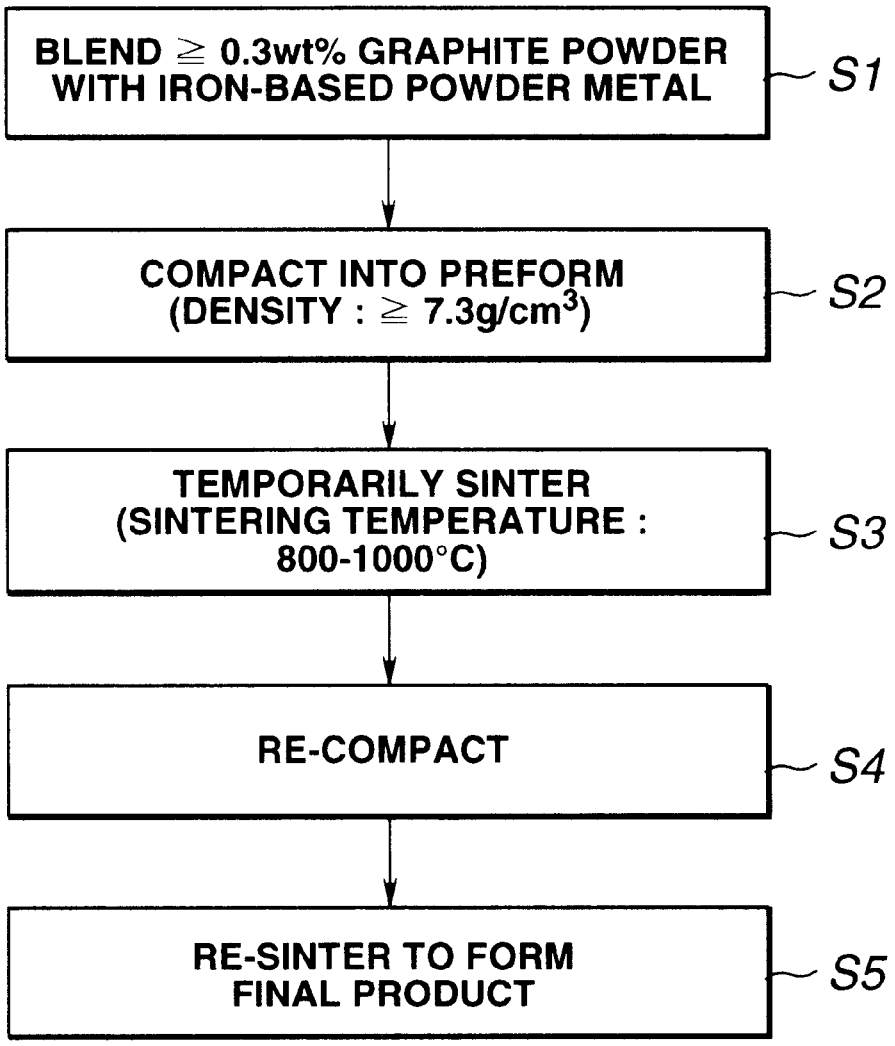
FIG. 1 is a flow chart of a process for producing a sintered powder metal body according to the present invention.

Referring now to FIG. 1, a process for producing a sintered powder metal body, according to the present invention, is explained. In FIG. 1, an additional process, as after treatment, for making a final product from the sintered powder metal body formed by the process of the present invention is also illustrated.

As illustrated in FIG. 1, the process includes the following steps S1, S2 and S3 and the additional process includes S4 and S5.

At the step S1, a graphite powder is blended with an iron based metal powder to form a powdery mixture. The graphite powder is present in an amount of not less than 0.3% by weight, preferably of 0.3 to 0.8% by weight, on the basis of the weight of the powdery mixture. The graphite powder has a mean particle diameter in the range of 5 to 30 $\mu$m and the iron based metal powder has a mean particle diameter in the range of 40 to 250 $\mu$m. By blending the graphite powder in the amount of not less than 0.3% by weight, the mechanical strength of the final product to be fabricated from the sintered powder metal body in the additional process, can be increased to substantially the same as that of a casted and forged article.

The process then proceeds to the step S2 at which the powdery mixture prepared at the step S1 is compacted into a preform having a density of not less than 7.3 g/cm$^3$, by using an apparatus as explained later.

Subsequently, at the step S3, the preform formed at the step S2 is sintered at a predetermined temperature in the range of 800 to 1000° C. to form the sintered powder metal body having a predetermined structure as described later.

The thus-produced sintered powder metal body can be subjected to re-compacting and then re-sintering at the additional process as after treatment. At the step S4, the sintered powder metal body is re-compacted, for instance, by cold forging. Then, at the step S5, the sintered powder metal body re-compacted at the step 4 is re-sintered to form the final product.

FIGS. 2A to 2D show the compaction of the powdery mixture which is carried out at the step S2 as shown in FIG. 1, and the apparatus used therefor.

Figures 2A, 2B, 2C, 2D:
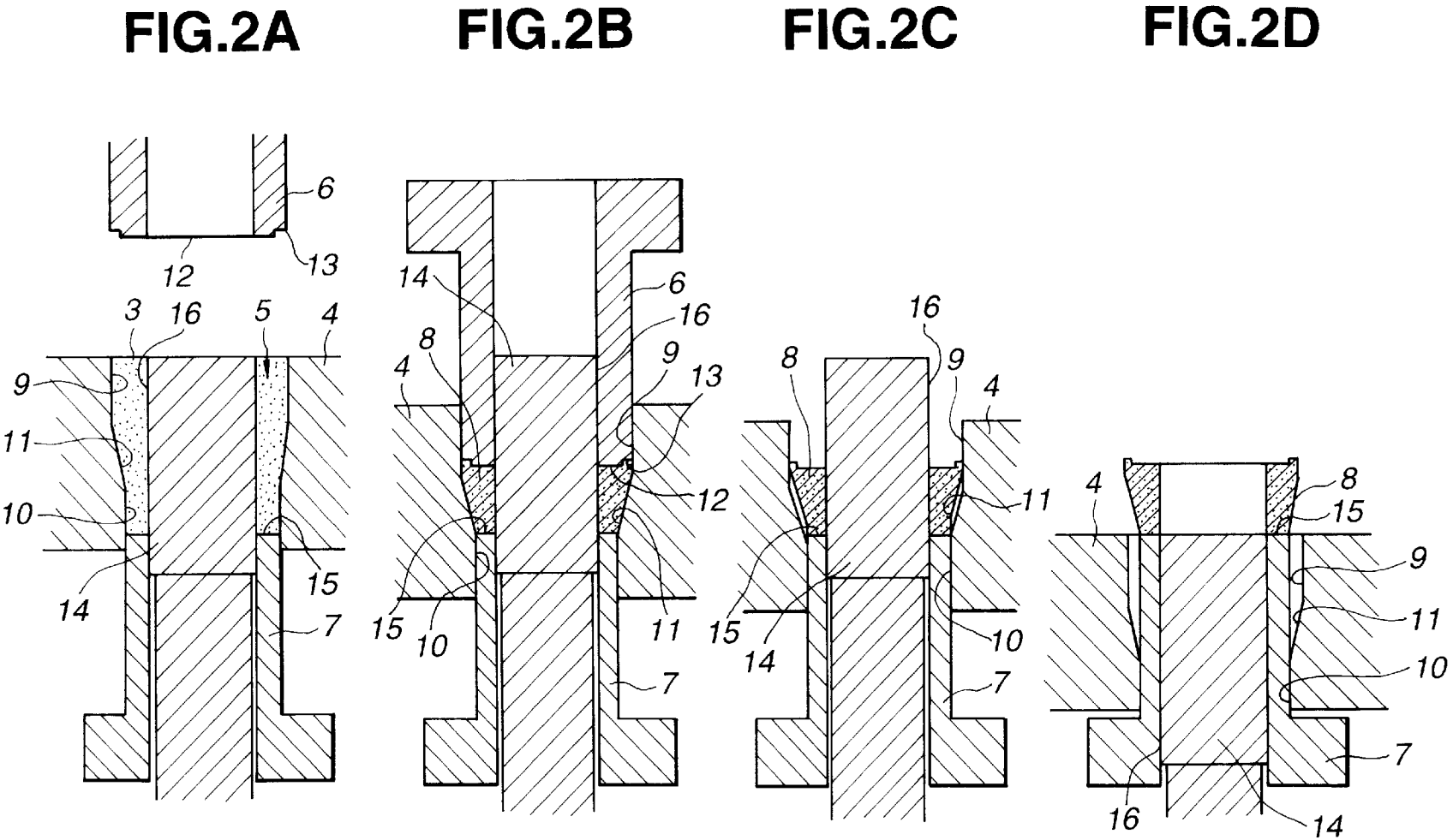
FIGS. 2A–2D are explanatory diagrams of a part of the process, showing an apparatus for forming a metal powder into a preform, which is used in the process of FIG. 1.

As illustrated in FIG. 2A, the apparatus includes a die 4 having a cavity 5 and a die surface defining the cavity 5, and two opposed, upper and lower, punches 6 and 7 adapted to move into and out of the cavity 5. The powdery mixture 3 prepared at the step S1 is introduced into the cavity 5. The cavity 5 of the die 4 has a generally cylindrical shape and includes a greater diameter portion 9, a smaller diameter portion 10, and a tapered portion 11 connecting the greater and smaller diameter portions 9 and 10.

The upper punch 6 has a hollow cylindrical portion configured to slidably fit into the greater diameter portion 9 of the cavity 5 of the die 4. The upper punch 6 is arranged such that the cylindrical portion is moveable into the cavity 5 in a direction of the center axis thereof. The upper punch 6 is adapted to stop the axial movement at a predetermined press position shown in FIG. 2B, within the greater diameter portion 9 of the cavity 5, in which the hollow cylindrical portion compresses the powdery mixture 3. The upper punch 6 has an upper-control surface 12 on the distal end of the hollow cylindrical portion. The upper-control surface 12 is pressed on the powdery mixture 3 at the predetermined press position to contour an upper face of the preform 8 as shown in FIG. 2B. The lower punch 7 has a hollow cylindrical portion configured to slidably fit into the smaller diameter portion 10 of the cavity 5 of the die 4. The lower punch 7 is arranged such that the hollow cylindrical portion is moveable within the cavity 5 in a direction of the center axis thereof. The lower punch 7 has a predetermined press position within the smaller diameter portion 10 of the cavity 5 as shown in FIG. 2B, in which the hollow cylindrical portion thereof compresses the powdery mixture 3. The lower punch 7 has a lower-control surface 15 on the distal end of the hollow cylindrical portion. The lower-control surface 15 is pressed on the powdery mixture 3 at the predetermined press position to contour a bottom face of the preform 8. The upper- and lower-control surfaces 12 and 15 of the upper and lower punches 6 and 7 cooperate with the die surface of the die 4 to define a predetermined volumetric molding space which forms a part of the cavity 5.

At least one of the upper and lower punches 6 and 7 has a recessed portion 13 increasing the predetermined volumetric molding space. In this embodiment, the recessed portion 13 is in the form of a groove which is formed on a circumferential periphery of the upper-control surface 12 of the upper punch 6. The groove has a generally L-shaped profile in section taken along the center axis of the upper punch 6 as shown in FIG. 2A. The recessed portion 13 can be formed on the lower punch 7 or both of the control surfaces 12 and 15 of the upper and lower punches 6 and 7.

A cylindrical-shaped core 14 is disposed within the cavity 5 of the die 4. The core 14 has one end portion onto which the hollow cylindrical portion of the lower punch 7 is slidably fitted, and an opposite end portion on which the hollow cylindrical portion of the upper punch 6 is slidably moveable. The core 14 has a circumferential surface 16 defining a generally hollow-cylindrical space within the volumetric molding space. The generally hollow-cylindrical space is filled with the powdery mixture 3 as shown in FIG. 2A. The circumferential surface 16 of the core 14 cooperates with the die surface of the die 4 and the control surfaces 12 and 15 of the upper and lower punches 6 and 7 to configure the powdery mixture 3 to a generally cylindrical, partly frustoconical, hollowed body of the preform 8 as shown in FIGS. 2B to 2D.

An operation of the apparatus is explained hereinafter.

First, as illustrated in FIG. 2A, the powdery mixture 3 is charged into the cavity 5 of the die 4 at an ordinary temperature. The lower punch 7 is placed in a position as shown in FIG. 2A, where the distal end of the cylindrical portion is disposed within the smaller diameter portion 10 of the cavity 5.

Subsequently, as illustrated in FIG. 2B, the upper punch 6 is inserted into the greater diameter portion 9 of the cavity 5 and moves to the predetermined press position thereof. The lower punch 7 further moves to be placed in the predetermined press position thereof. The upper punch 6 and the lower punch 7 cooperate with each other to compress the powdery mixture 3 into the preform 8 of the generally hollow-cylindrical shape in the respective predetermined press positions. At this time, the die surface of the die 4 is pressed against the powdery mixture 3 to contour an outer circumferential face of the preform 8, while the circumferential surface 16 of the core 14 is pressed on the powdery mixture 3 to contour an inner circumferential face of the preform 8. At the same time, a part of the powdery mixture 3 is moved into the recessed portion 13 of the upper punch 6 to form a less density portion within the preform 8. Thus, the preform 8 has a lower density at the less density portion than at the remainder portion.

Then, as illustrated in FIG. 2C, the upper punch 6 upwardly moves to retard the cylindrical portion from the cavity 5 and the die 4 downwardly moves on the cylindrical portion of the lower punch 7.

Next, the die 4 moves further downwardly to a position as shown in FIG. 2D, in which the preform 8 on the control surface 15 of the cylindrical portion of the lower punch 7 is came out of the cavity 5 of the die 4. The preform 8 then can be taken out of the die 4 and the lower punch 7.

From the experiments made by the present inventors, it has been recognized that in the case of applying the load to the powdery mixture 3 having the contents of zinc stearate as a lubricant, 0.2, 0.3 and 0.4% by weight, at 10 tonf/cm2 in the compaction step, the densities of the preforms 8 made were 7.57, 7.55 and 7.47, respectively.

The preform 8 can be made by so-called warm molding in which, before the compression of the powdery mixture 3, the powdery mixture 3 and the die 4 are heated at a predetermined temperature so as to lower the yield point of the powdery mixture 3.

The preform 8 having not less than 7.3 g/cm$^3$ can be readily obtained as a green compact by thus using the apparatus.

Generally, in compaction of the powdery mixture, the greater the density of the compacted body is, the higher the friction caused between the compacted body and the die becomes and the greater the spring back of the compacted body becomes. This prevents the compacted body from being readily taken out of the die, and especially, in the case of taking the compacted body having a relatively high density out of the die.

In the apparatus according to the present invention and the compaction step using the apparatus, the problem described above can be solved.

Namely, since the tapered portion 11 of the cavity 5 of the die 4 acts as draft, the preform 8 can be easily taken out of the cavity 5 of the die 4. Thus, the tapered portion 11 serves for facilitating the operation of taking the preform 8 from the die 4.

Further, with the arrangement of the recessed portion 13 on the periphery of the control surface 12 of the upper punch 6, the volumetric molding space is increased so that the density of the preform 8 is reduced locally. That is, the preform 8 has the less density portion which is located near the recessed portion 13 of the upper punch 6 at the end of the compaction at the step S2 of the process according to the present invention. As a result of the provision of the less density portion in the preform 8, the friction between the preform 8 and the die 4 and the spring back of the preform 8 are effectively restricted, serving for easily taking the preform 8 out of the die 4.

Figures 3A, 3B:
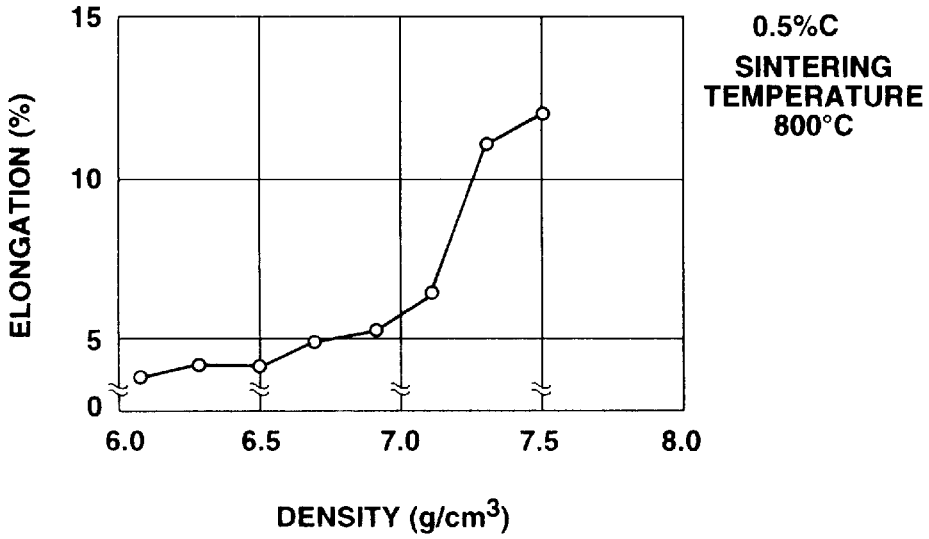
FIG. 3A is a table showing data on a relationship between a density of the preform and an elongation of a sintered powder metal body made from the preform.
FIG. 3B is a graph representing the relationship shown in FIG. 3A.

The preform 8 having not less than 7.3 g/cm$^3$ is formed into the sintered powder metal body at the step S3 by being subjected to temporary sintering at the temperature of 800 to 1000° C. FIGS. 3A and 3B show a relationship between the density of the preform as a green compact and the elongation of the sintered powder metal body made from the preform. In FIGS. 3A and 3B, the sintered powder metal bodies are produced by sintering the preforms having the density of 6.1 to 7.5 g/cm$^3$ at the temperature of 800° C. Each of the preforms is made from the powder mixture including an iron based metal powder and a graphite powder present in the amount of 0.5% by weight. In FIG. 3A, the density of the preforms is represented as density (g/cm$^3$) and the elongation of the sintered powder metal bodies is represented as elongation (%). In FIG. 3B, the density of the preform and the elongation of the sintered powder metal body are represented as the same as in FIG. 3A, and the 0.5% by weight graphite powder is represented as 0.5% C. As shown in FIGS. 3A and 3B, the sintered powder metal bodies made from the preforms having the density of not less than 7.3 g/cm$^3$ have the elongation of not less than 10%.

Figure 4:
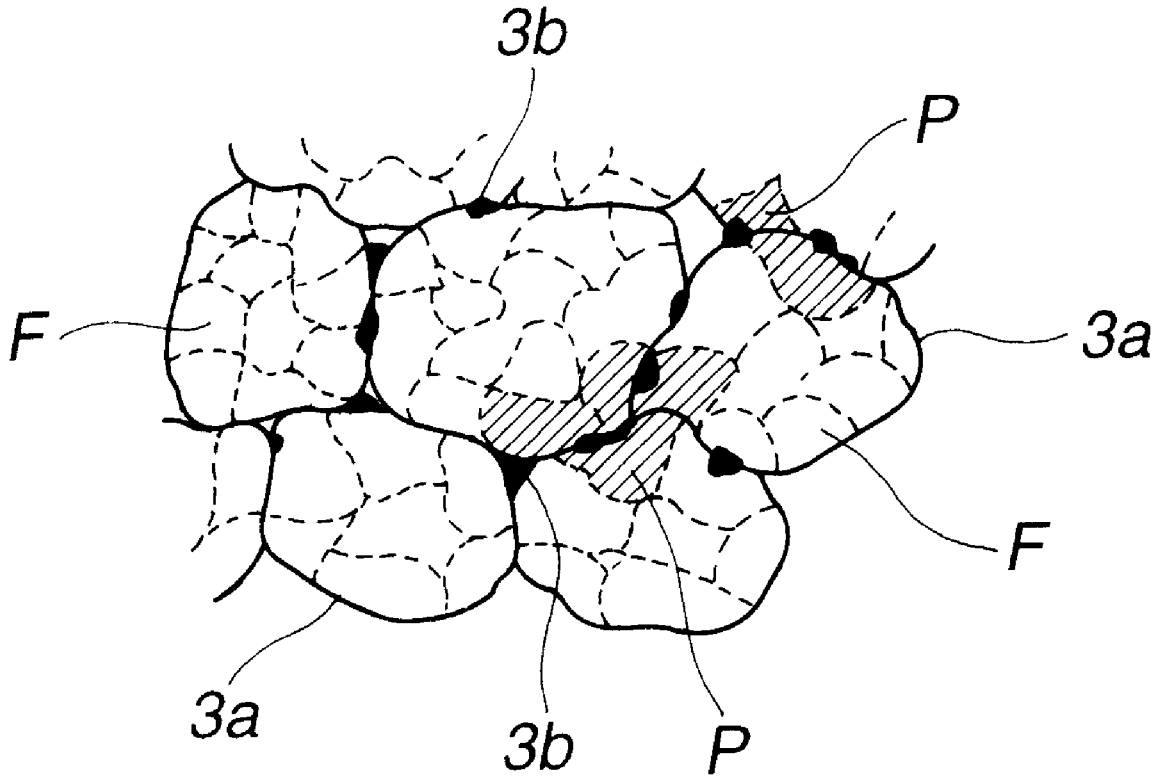
FIG. 4 is a sketch of a structure of the sintered powder metal body.

The sintered powder metal body formed by sintering the preform 8 made at the step S2, at the temperature of 800 to 1000° C., has the predetermined structure which includes iron based metal particles and graphite particles retained between the iron based metal particles. Specifically, the predetermined structure of the sintered powder metal body contains the graphite particles retained on the iron based metal particles, but contains no graphite particles precipitated along grain boundaries of the iron based metal particles nor iron based metal particles consisting of pearlite as a whole. In a case where a total amount of the graphite particles blended is retained between the iron based metal particles in the predetermined structure of the sintered powder metal body, the iron based metal particles may be constituted by ferrite as a whole. In a case where a part of the graphite particles blended is retained between the iron based metal particles in the predetermined structure of the sintered powder metal body and the remainder of the graphite particles blended is incorporated into the crystal structure of the iron based metal particles, the iron based metal particles may be constituted by ferrite as a matrix and pearlite precipitated near the graphite particles retained therebetween, namely, precipitated at a surface portion of each iron based metal particle. FIG. 4 shows the predetermined structure in the latter case. In FIG. 4, references 3*a* and 3*b* respectively denote the iron based metal particles and the graphite particles retained therebetween, and references F and P respectively represent ferrite as the matrix and pearlite precipitated in the vicinity of the graphite particles 3*b* retained. With the predetermined structure, the sintered powder metal body has a greater elongation and a less hardness, whereby it has excellent deformability.

In addition, the structure of the preform 8 having the density of 7.3 g/cm$^3$ or more influences the greater elongation of the sintered powder metal body. In the structure of the preform 8 having such the density, the iron based metal particles are present in more compact state to define therebetween such a limited void that an ambient gas within a sintering furnace can be prevented from entering deep the structure of the preform 8 therethrough at the subsequent sintering step S3. This restricts carburizing of the preform 8 in the sintering, resulting in that the sintered powder metal body has the greater elongation. Further, since carbon is hardly diffused in the structure of the preform 8 having the density of 7.3 g/cm$^3$ or more at the sintering step S3, the elongation of the sintered powder metal body made from the preform 8 may be less influenced by the amount of the graphite powder blended and the hardness of the sintered powder metal body can be lowered.

Furthermore, since, at the sintering step S3, the sintering occurs to a larger extent by the surface diffusion or melting caused on mutually contacting surfaces of the iron based metal particles of the structure of the preform 8, the sintered powder metal body can have the greater elongation, i.e., of 10% or more.

By sintering the preform 8 at the temperature of 800 to 1000° C., the sintered powder metal body can have a good deformability suitable for forming the final product having a predetermined shape at the subsequent step S4 of re-compacting, for instance, cold forging. The sintered powder metal body with the good deformability has a reduced deformation resistance, so that the forming of the sintered powder metal body into the final product can be facilitated. A factor of the good deformability resides in the greater elongation, 10% or more, of the sintered powder metal body formed by sintering the preform 8 at the temperature of 800 to 1000° C.

Figures 5A, 5B:
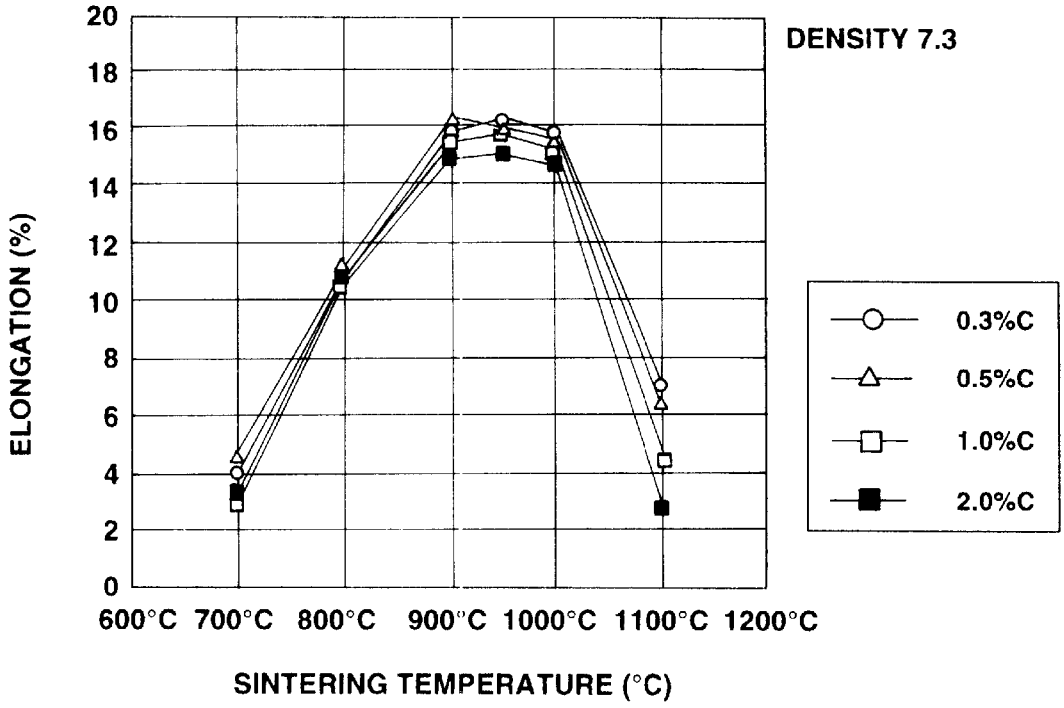
FIG. 5A is a table showing data on a variation of elongation of the sintered powder metal body with variations of an amount of a graphite powder present in the preform having 7.3 g/cm$^3$ and a sintering temperature.
FIG. 5B is a graph representing the variation of elongation shown in FIG. 5A.

An elongation variation in the sintered powder metal bodies formed by sintering the preforms 8 which are made from the powdery mixtures 3 including the iron based metal powder and the graphite powder present in the amounts of 0.3, 0.5, 1.0 and 2.0% by weight and have the density of 7.3 g/cm$^3$, at the temperature of 700 to 1100° C., is shown in FIGS. 5A and 5B. In FIG. 5A, the elongation of the sintered powder metal bodies is represented as elongation (%) and the amount of the graphite powder blended is represented as amount of graphite (blended, wt %). In FIG. 5B, the elongation of the sintered powder metal bodies is represented as the same as in FIG. 5A, and the respective amounts of the graphite powder blended are represented as 0.3% C, 0.5% C, 1.0% C and 2.0% C.

Figures 6A, 6B:
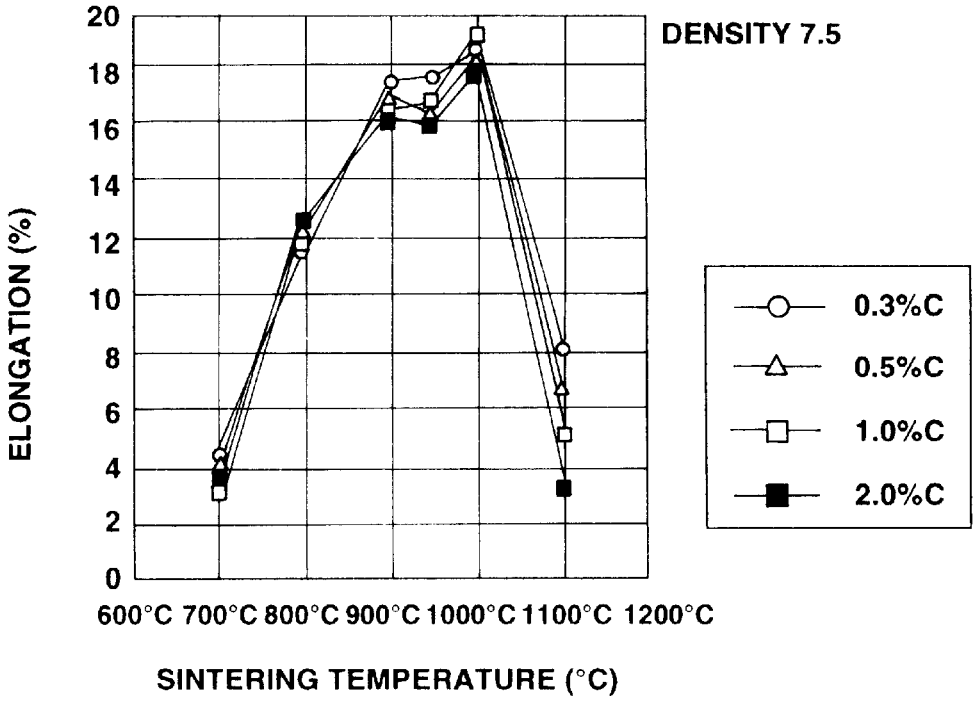
FIG. 6A is a table similar to FIG. 5A, but in which the preform has 7.5 g/cm$^3$.
FIG. 6B is a graph representing the variation shown in FIG. 6A.

FIGS. 6A and 6B show the elongation variation in the sintered powder metal bodies, which are similar to FIGS. 5A and 5B except that the sintered powder metal bodies are made from the preforms having the density of 7.5 g/cm$^3$.

As seen from FIGS. 5A, 5B, 6A and 6B, the elongation of the sintered powder metal body formed by sintering the preform 8 having the density of 7.3 g/cm$^3$ and 7.5 g/cm$^3$ and the graphite content of 0.3 to 2.0% by weight, at the temperature in the range of 800 to 1000° C., is not less than 10%. It will be appreciated that the sintered powder metal body having the relatively greater elongation of 10% or more may be obtained by sintering the preform 8 having the density of 7.3 to 7.5 g/cm$^3$.

Figures 7A, 7B:
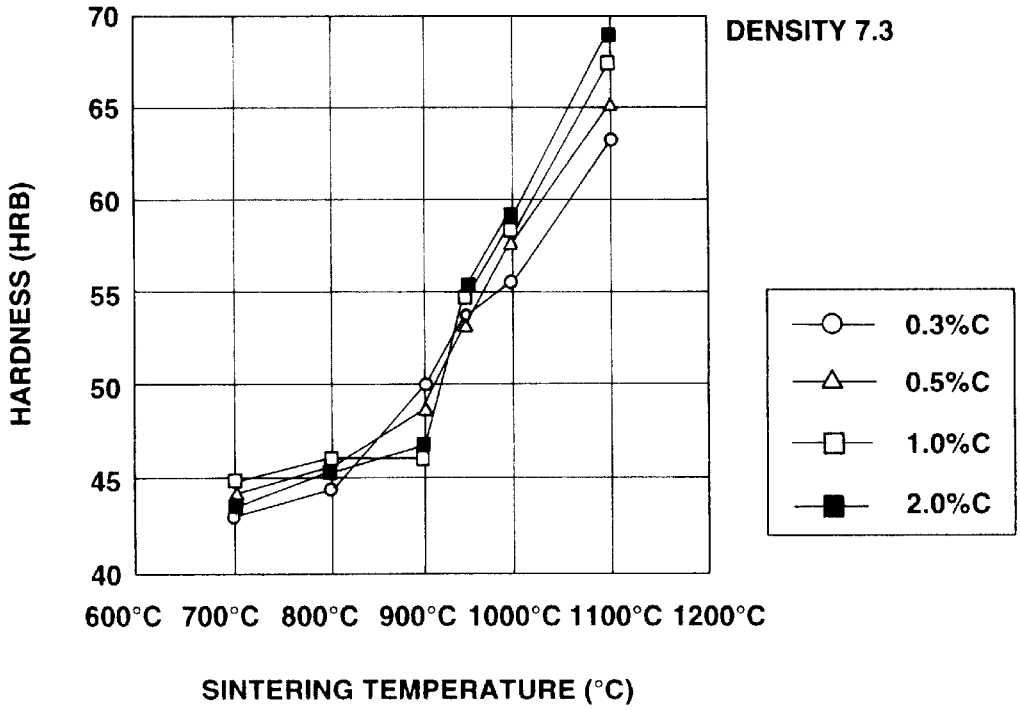
FIG. 7A is a table showing data on a variation of hardness of the sintered powder metal body with variations of the amount of the graphite powder present in the preform having 7.3 g/cm$^3$ and the sintering temperature.
FIG. 7B is a graph representing the variation of hardness shown in FIG. 7A.

FIGS. 7A and 7B show a hardness variation in the sintered powder metal bodies formed by sintering the preforms 8 which are made from the powdery mixtures 3 including the iron based metal powder and the graphite powder present in the amounts of 0.3, 0.5, 1.0 and 2.0% by weight and have the density of 7.3 g/cm$^3$, at the temperature of 700 to 1100° C. In FIG. 7A, the hardness of the sintered powder metal bodies is represented as hardness of Rockwell B Scale (HRB) and the amount of the graphite powder blended is represented as amount of graphite (blended, wt %). In FIG. 7B, the respective amounts of the graphite powder blended are represented as the same as FIG. 5B.

Figures 8A, 8B:
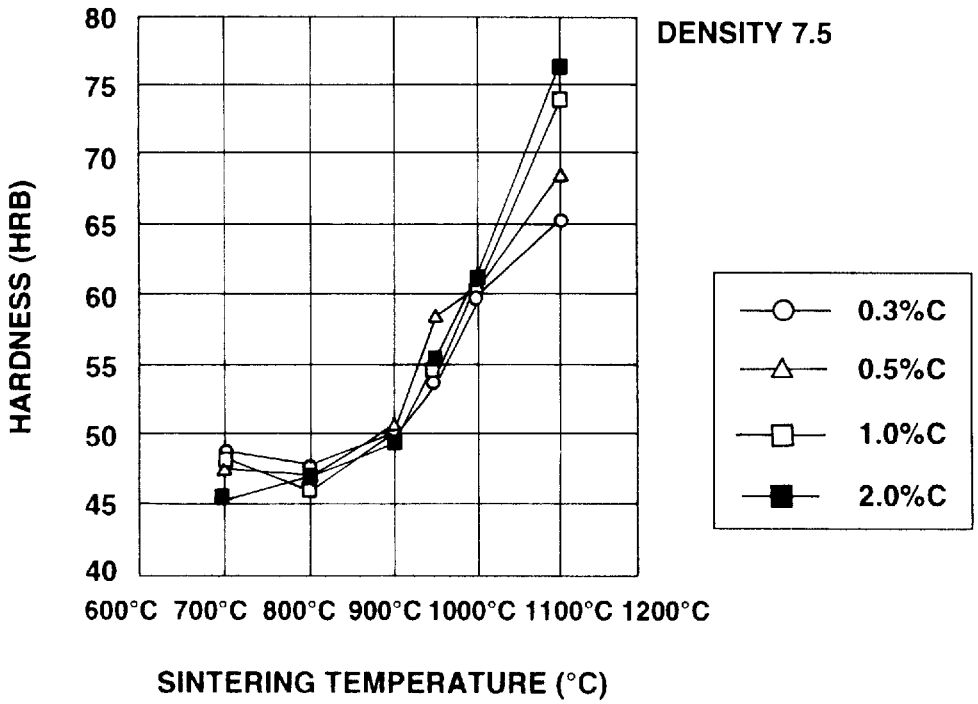
FIG. 8A is a table similar to FIG. 7A, but in which the preform has 7.5 g/cm$^3$.
FIG. 8B is a graph representing the variation shown in FIG. 8A.

FIGS. 8A and 8B show the hardness variation in the sintered powder metal bodies, which are similar to FIGS. 7A and 7B except that the sintered powder metal bodies are made from the preforms 8 having the density of 7.5 g/cm$^3$.

As shown in FIGS. 7A, 7B, 8A and 8B, the hardness of the sintered powder metal body formed by sintering the preform 8 having the density of 7.3 g/cm$^3$ and 7.5 g/cm$^3$ and the graphite content of 0.3 to 2.0% by weight, at the temperature in the range of 800 to 1000° C., is substantially not more than 60 HRB. It will be appreciated that the sintered powder metal body having the hardness of substantially 60 HRB or less can be obtained by sintering the preform 8 having the density of 7.3 to 7.5 g/cm$^3$ and the graphite content of 0.3 to 2.0% by weight, at the temperature in the range of 800 to 1000° C. The hardness of not more than 60 HRB is lower than the hardness exhibitable in the case of annealing a low carbon steel which has a carbon content of approximately 0.2%.

Figures 9A, 9B:
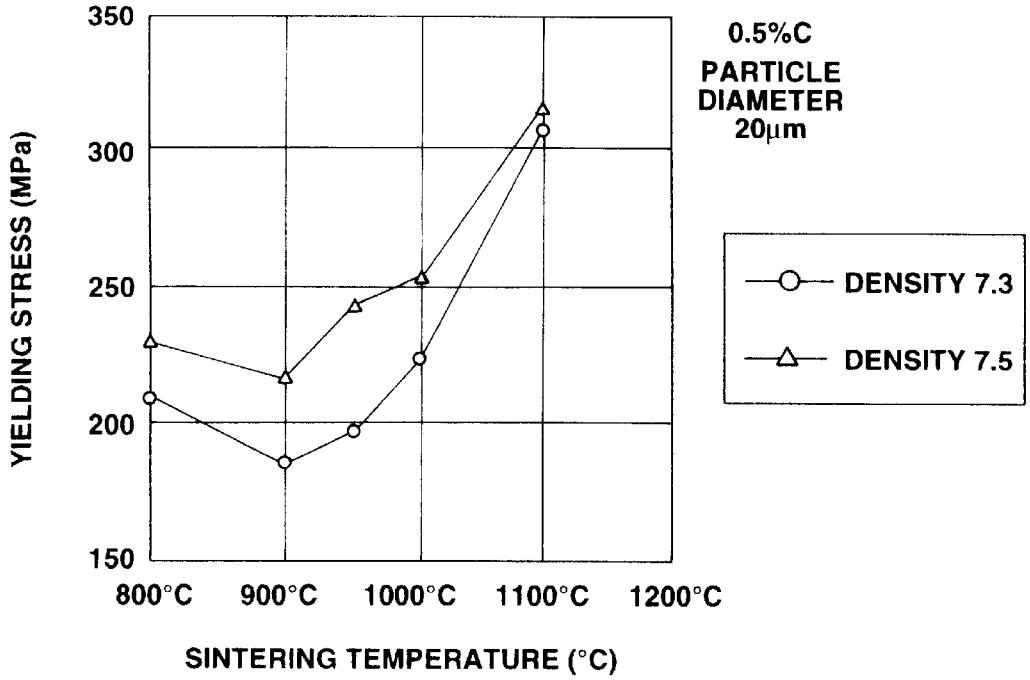
FIG. 9A is a table showing a relationship between a sintering temperature and a yielding stress of the sintered powder metal bodies, in which the sintered powder metal bodies are made from preforms different in density and containing the graphite powder having a mean particle diameter of 20 $\mu$m.
FIG. 9B is a graph representing the relationship shown in FIG. 9A.

FIGS. 9A and 9B show a relationship between the sintering temperature and the yielding stress of the sintered powder metal bodies made by sintering the preforms 8 having the density of 7.3 g/cm$^3$ and 7.5 g/cm$^3$ at the temperature of 700 to 1100° C. The preforms 8 are made from the powdery mixture 3 containing the iron based metal powder having a mean particle diameter of 80 $\mu$m and the 0.5% by weight graphite powder having a mean particle diameter of 20 $\mu$m. In FIG. 9A, the yielding stress of the sintered powder metal bodies is represented as yield point (MPa).

Figures 10A, 10B:
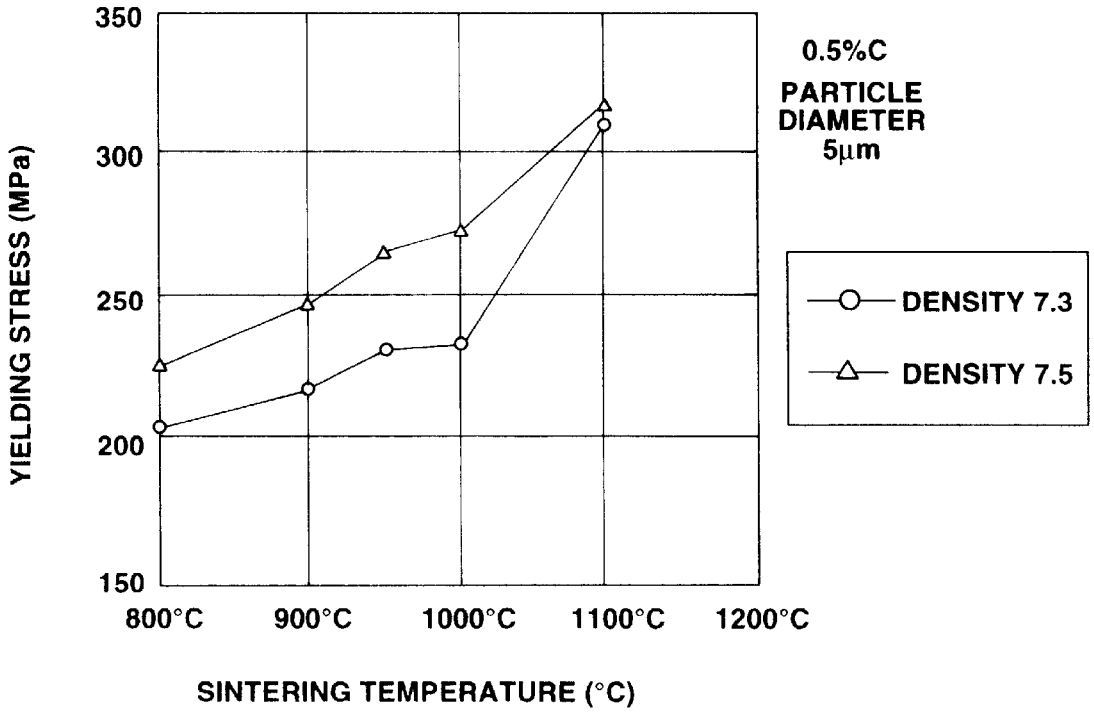
FIG. 10A is a table similar to FIG. 9A, but wherein the graphite powder has a mean particle diameter of 5 $\mu$m.
FIG. 10B is a graph representing the relationship shown in FIG. 10A.

FIGS. 10A and 10B show the relationship the sintering temperature and the yielding stress of the sintered powder metal bodies, which are similar to FIGS. 9A and 9B except that the graphite powder contained in the powdery mixture 3 has a mean particle diameter of 5 $\mu$m.

As seen from FIGS. 9A, 9B, 10A and 10B, in the case of sintering the preforms 8 having the density of 7.3 g/cm$^3$ and 7.5 g/cm$^3$ at the temperature of 800 to 1000° C., the yielding stress of the sintered powder metal bodies falls in the range of 202 to 272 MPa. The lower the yielding stress of the sintered powder metal body is, the smaller the deformation resistance of the sintered powder metal body becomes. The yielding stress in the range of 202 to 272 MPa is lower than the yielding stress of a low carbon steel having a carbon content of approximately 0.2%.

It will be appreciated from the above description that the sintered powder metal body which has the greater elongation of 10% or more, the lower hardness of substantially 60 HRB or less and the lower yielding stress of 202 to 272 MPa, to thereby exhibit the excellent deformability, can be fabricated by the process of the present invention.

Further, according to the present invention, the sintered powder metal body having the predetermined structure can be obtained, which includes the certain amount of the graphite particles retained between the iron based metal particles, contributing to the greater elongation and the lower hardness of the sintered powder metal body.

EXAMPLES

The present invention is described in more detail by way of examples by referring to the accompanying drawings. However, these examples are merely illustrative and not intended to limit the scope of the present invention.

Example 1

A powdery mixture was prepared by blending a graphite powder in an amount of 0.5% by weight with an iron based metal powder. The graphite powder blended had a mean particle diameter of 20 $\mu$m and the iron based metal powder had a mean particle diameter of 80 $\mu$m. The powdery mixture prepared was compacted into preforms having a density of 7.3 g/cm$^3$. Then, the preforms were sintered in a nitrogen atmosphere within a stainless-mesh sintering furnace at a temperature of 900° C. for a sintering time varying from 60 to 120 minutes, to be formed into sintered powder metal bodies. The thus-formed sintered powder metal bodies were subjected to an elongation test and a hardness test to measure the elongation and the hardness thereof.

Figure 11A:
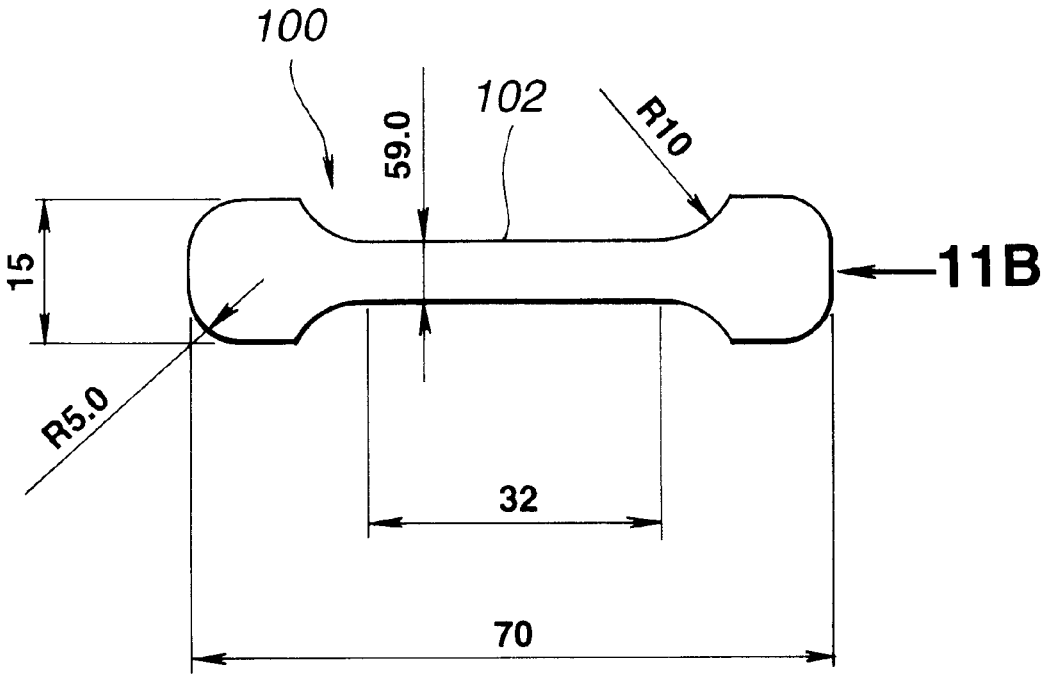
FIG. 11A is a plan view of a test specimen used in Examples 1, 2 and Reference Example 1 described herein.
Figure 11B:
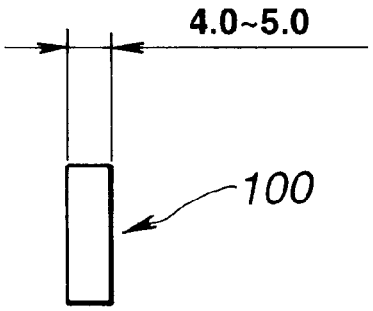
FIG. 11B is a side view as viewed from a direction indicated by arrow 11B of FIG. 11A.

Next, tension test specimens 100 shown in FIGS. 11A and 11B were made from products produced by cold-forging the sintered powder metal bodies and re-sintering the cold-forged sintered powder metal bodies at 1100° C. The test specimens 100 had a density of 7.81–7.85 g/cm$^3$ that was equal to the density of carbon steel. As illustrated in FIGS. 11A and 11B, the test specimens 100 had a bar-like configuration and had a straight portion 102 and two head portions formed at opposite ends of the straight portion 102. In FIGS. 11A and 11B, a dimensional unit is millimeter. The test specimens 100 were subjected to a tension test to measure the tensile strength thereof. The test specimens 100 were also subjected to a heat treatment and then a tension test to measure the tensile strength thereof.

As a result, it was found that the elongation and the hardness of the sintered powder metal bodies were: Elongation—16.2%; and Hardness—48.8 HRB. It was recognized that the variation of the sintering time within the above-described range was less influenced on the elongation and the hardness of the sintered powder metal bodies.

It was found that the test results of the tensile strength of the test specimens 100 in the former case were 637N/mm$^2$ and the test results of the tensile strength of the test specimens 100 in the latter case were 1000N/mm$^2$.

Example 2

A powdery mixture was prepared and made into preforms in the same procedure as described in Example 1 except that the preforms had a density of 7.5 g/cm$^3$. Sintered powder metal bodies were made from the preforms made in the same procedure as described in Example 1. The sintered powder metal bodies made were subjected to an elongation test and a hardness test to measure the elongation and the hardness thereof in the same procedure as described in Example 1.

Next, the tension test specimens 100 were made in the same procedure as described in Example 1. The tension tests described in Example 1 were repeated.

It was found that the elongation and the hardness of the sintered powder metal bodies were: Elongation—16.9%; and Hardness—50.6 HRB. It was recognized that the variation of the sintering time within the above-described range was less influenced on the elongation and the hardness of the sintered powder metal bodies.

It was discovered that the test results of the tensile strength were equal to the test results thereof described in Example 1.

Example 3

0.5% by weight of a graphite powder having a means particle diameter of 5 $\mu$m was blended with 99.5% by weight of an iron based powder KIP 301A manufactured by Kawasaki Steel Corporation and consisting of not more than 0.01 wt % C, not more than 0.05 wt % Si, 0.1–0.25 wt % Mn, not more than 0.025 wt % P, not more than 0.025 wt % S, not more than 0.25 wt % O and balance Fe, to prepare a powdery mixture. The thus-prepared powdery mixture was compacted using a 500-ton pressing apparatus, to thereby produce preforms of a generally cylindrical tablet-like shape having a density of 7.5 g/cm$^3$. Meanwhile, each of the preforms was formed on one end surface thereof with an annular projection having a length of 0.15 mm and had an outer diameter of 30 mm, an inner diameter of 26 mm which is defined by the annular projection, and a length of 13 mm. The thus-produced preforms were sintered at a temperature of 900° C. for 60 minutes in a nitrogen atmosphere within a stainless-mesh furnace. The sintered preforms were cold-forged using a 400-ton cold-forging pressing apparatus, thereby producing cold-forged cylindrical bodies having a bore. The cold-forged cylindrical bodies were wire-cut to form a hollow cylindrical bearings. The thus-formed bearings were re-sintered under at a temperature of 1130° C. for 20 minutes and then subjected to heat treatment including carburization, quenching and tempering to form radial-crushing test specimens 300 illustrated in FIGS. 12A and 12B. The thus-formed radial-crushing test specimens 300 had an outer diameter indicated at D in FIG. 12A, of 30.0 mm, a thickness indicated at T in FIG. 12A, of 3.35 mm, and a length indicated at L in FIG. 12B, of 10.0 mm.

Figure 12A:
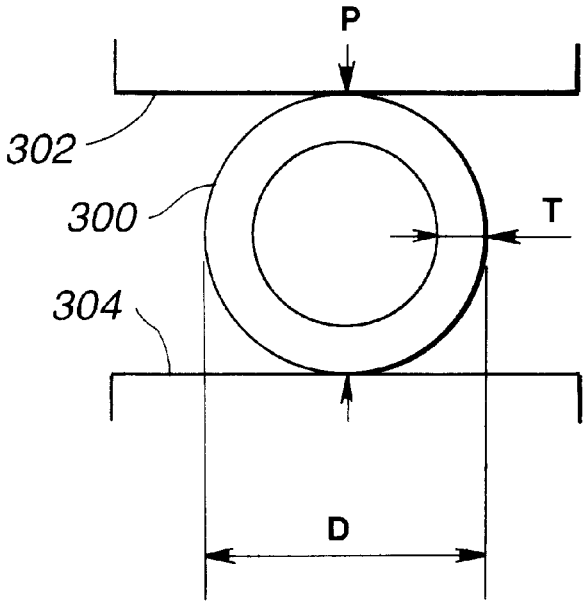
FIGS. 12A and 12B are explanatory diagrams of a radial-crushing test, showing front and side views of a test specimen used in Example 3 described herein.
Figure 12B:
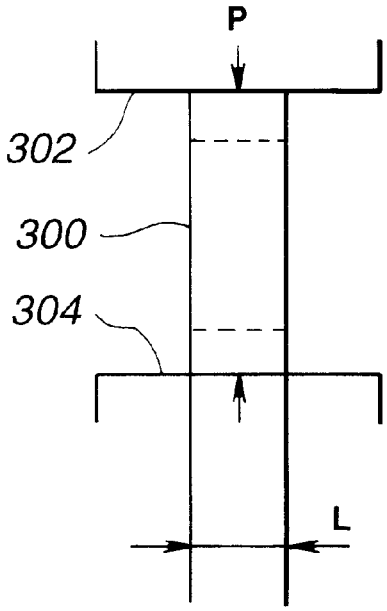

The test specimens 300 were subjected to a radial-crushing test according to JIS Z 2507, as shown in FIGS. 12A and 12B. Each of the test specimens 300 was interposed between opposed press surfaces 302 and 304 parallel to a center axis of the test specimen 300 and subjected to application of pressure indicated by arrows P of FIGS. 12A and 12B.

It was found that the radial crushing strength of the test specimen 300 was 8755 (N). A radial crushing strength constant of the test specimen 300 was calculated from the radial crushing strength by using the following formula (1)

$$K=P(D-T)/L\cdot T^2 \quad (1)$$

wherein K: radial crushing strength constant ($N/mm^2$)

P: radial crushing strength (N)

D: bearing outer diameter (mm)

T: bearing thickness (mm)

L: bearing length (mm)

The calculation result was as follows:

$$K=2079.0\ (N/mm^2)(max.)$$

A tensile strength of the test specimen 300 was calculated from the above-calculated radial crushing strength constant thereof by using the following U.S.A. MPIF* conversion formula (2)

$$\text{Tensile Strength}=2.14K/4(N/mm^2) \quad (2)$$

*: Metal Powder Industries Federation

The calculated tensile strength of the test specimen 300 was 1112.3 ($N/mm^2$) (max.).

It will be appreciated that the cold-forged cylindrical bodies have a greater tensile strength than the above-calculated tensile strength of the test specimen 300. This is because that the tensile strength of the cold-forged cylindrical bodies decreases in the subsequent processes of re-sintering and heat treatment while the hardness thereof increases in the subsequent processes. The cold-forged cylindrical bodies having the greater tension strength can be used in various application requiring a good deformability, without being subjected to the subsequent processes.

Reference Example 1

Powdery mixtures were prepared in the same manner as described in Example 1 except that the amounts of the graphite powder blended were 0.5, 0.8 and 1.0% by weight, respectively. Preforms were made from the thus-prepared powdery mixtures and then formed into sintered powder metal bodies in the same procedure as described in Example 1. The test specimens 100 were prepared in the same procedure as described in Example 1 and then subjected to a tension test to measure a yield strength thereof.

It was found that the test results of the yield strength of the test specimens were 15, 20 and 25 $kg/mm^2$, respectively. When the graphite powder blended was not more than 0.8% by weight, the test specimen exhibited the yield strength of 20 $kg/mm^2$ or less. The yield strength of 20 $kg/mm^2$ or less is desirable for reduction of a deformation resistance of the sintered powder metal body, serving for a good deformability of the sintered powder metal body. It can be understood that the amount, not more than 0.8% by weight, of the graphite powder blended contributes to achieving the good deformability of the sintered powder metal body. Meanwhile, the yield strength of the test specimen exhibited when the graphite powder blended was more than 0.8 to 10% by weight is lower than the yield strength obtainable in the case of annealing an ordinary carbon steel having the carbon content of 0.3%. It will be appreciated that the sintered powder metal body fabricated by the process of the invention may exhibit the reduced deformation resistance to have the deformability better than such the annealed ordinary carbon steel. Accordingly, it will be noted that the load required for re-compacting the sintered powder metal body in the process as after-treatments can be reduced owing to the reduced deformation resistance. The reduction of the re-compaction load enables omission of bonderising which is generally carried out before the cold forging subsequent to the re-compaction in order to decrease the friction resistance caused between the annealed ordinary carbon steel and the die and readily take the sintered powder metal body out of the die. This results in saving of the fabricating time and elimination of an adverse influence of a waste solution of phosphate used in the bonderising, on the environment.

Industrial Applicability

The sintered powder metal body of the present invention has a graphite content suitable for enhancing the mechanical strength of machine parts as final products, and exhibits specific properties, i.e., an increased elongation, a reduced hardness and a good deformability. Using a process for forming the sintered powder metal body, according to the invention, the sintered powder metal body having the specific properties can be fabricated. Subjecting the sintered powder metal body of the present invention to after-treatments, the final products having substantially the same mechanical strength as those made by casting or forging, can be obtained.

What is claimed is:

1. A process for producing a sintered powder metal body, comprising the steps of:

blending a graphite powder with an iron based metal powder to form a powdery mixture, said graphite powder being present in an amount of not less than 0.3% by weight on the basis of the weight of said powdery mixture;

compacting said powdery mixture into a preform having a density of not less than 7.3 $g/cm^3$; and sintering said preform at a temperature in the range of 800 to 1000° C. to form the sintered powder metal body having a predetermined structure.

2. The process as claimed in claim 1, wherein the sintered powder metal body has elongation of not less than 10% and hardness of Rockwell B Scale (HRB) 60 or less.

3. The process as claimed in claim 1, wherein said predetermined structure comprises sintered iron based metal particles, and graphite particles retained between the sintered iron based metal particles.

4. A process for producing a sintered powder metal body, comprising the steps of:

blending a graphite powder with an iron based metal powder to form a powdery mixture, said graphite powder being present in an amount of not less than 0.3% by weight on the basis of the weight of said powdery mixture;

compacting said powdery mixture into a preform having a density of not less than 7.3 $g/cm^3$, said compacting comprising forming a part of said powdery mixture into a less dense portion within said preform; and sintering said preform at a predetermined temperature to form the sintered powder metal body having a predetermined structure.

5. A process for producing a sintered powder metal body, comprising the steps of:

blending a graphite powder with an iron based metal powder to form a powdery mixture, said graphite powder being present in an amount of not less than 0.3% by weight on the basis of the weight of said powdery mixture;

compacting said powdery mixture into a preform having a density of not less than 7.3 g/cm$^3$, said compacting the powdery mixture comprising:

placing a first punch having a first control surface in a cavity formed in a die;

introducing the powdery mixture into said cavity;

moving said first punch to a first predetermined press position within said cavity; and moving a second punch having a second control surface to a second predetermined press position within said cavity, in which said first and second control surfaces and a die surface defining said cavity cooperate to press the powdery mixture into said preform having a less density portion; and sintering said preform at a predetermined temperature to form the sintered powder metal body having a predetermined structure.

6. The process as claimed in claim 5, wherein at least one of said first and second punches has a recessed portion increasing a predetermined volumetric molding space which is defined by said first and second control surfaces and said die surface.

7. The process as claimed in claim 6, wherein said recessed portion includes a groove formed on a periphery of the control surface of said at least one of the first and second punches.

8. The process as claimed in claim 6, wherein said cavity has a generally cylindrical shape and includes a greater diameter portion, a smaller diameter portion, and a tapered portion connecting the greater and smaller diameter portions, said first punch is moveable into said greater diameter portion of said cavity, and said second punch is moveable into said smaller diameter portion.

9. A sintered powder metal body produced by a process comprising the steps of:

blending a graphite powder with an iron based metal powder to form a powdery mixture, said graphite powder being present in an amount of not less than 0.3% by weight on the basis of the weight of said powdery mixture;

compacting said powdery mixture into a preform having a density of not less than 7.3 g/cm$^3$; and sintering said preform at a temperature in the range of 800 to 1000° C. to form the sintered powder metal body having a predetermined structure.

10. The sintered powder metal body as claimed in claim 9, wherein the sintered powder metal body has elongation of not less than 10% and hardness of Rockwell B Scale (HRB) 60 or less.

11. The sintered powder metal body as claimed in claim 9, wherein said predetermined structure comprises iron based metal particles, and graphite particles retained between the iron based metal particles.

12. A sintered powder metal body produced by a process comprising the steps of:

blending a graphite powder with an iron based metal powder to form a powdery mixture, said graphite powder being present in an amount of not less than 0.3% by weight on the basis of the weight of said powdery mixture;

compacting said powdery mixture into a preform having a density of not less than 7.3 g/cm$^3$, said compacting comprising compressing said powdery mixture and at the same time permitting a part of said powdery mixture to form a less density portion in said preform; and sintering said preform at a predetermined temperature to form the sintered powder metal body having a predetermined structure.

13. A sintered powder metal body having a predetermined structure, the predetermined structure comprising:

sintered iron based metal particles; and graphite particles retained between said sintered iron based metal particles.

14. The sintered powder metal body as claimed in claim 13, wherein the sintered powder metal body contains carbon in an amount of not less than 0.3% by weight on the basis of the weight of the sintered powder metal body.

15. The sintered powder metal body as claimed in claim 13, wherein said sintered powder metal body has elongation of not less than 10% and hardness of Rockwell B Scale (HRB) 60 or less.

* * * * *